US007494576B2

(12) United States Patent
Rosenzweig et al.

(10) Patent No.: US 7,494,576 B2
(45) Date of Patent: Feb. 24, 2009

(54) ELECTROPLATING APPARATUS AND METHOD FOR MAKING AN ELECTROPLATING ANODE ASSEMBLY

(75) Inventors: Mark Alan Rosenzweig, Hamilton, OH (US); Robert George Zimmerman, Jr., Morrow, OH (US); John D. Evans, Sr., Springfield, OH (US)

(73) Assignee: General Electric Company, Schnectady, NY (US)

( * ) Notice: Subject to any disclaimer, the term of this patent is extended or adjusted under 35 U.S.C. 154(b) by 579 days.

(21) Appl. No.: 10/926,739

(22) Filed: Aug. 26, 2004

(65) Prior Publication Data

US 2006/0042933 A1 Mar. 2, 2006

(51) Int. Cl.
*C25B 11/02* (2006.01)

(52) U.S. Cl. ..... 204/288; 204/289; 204/286.1; 204/280; 204/278.5; 204/297.01; 204/297.06; 204/224 R; 204/212

(58) Field of Classification Search ..... 204/224 R, 204/278.5, 279, 280, 286.1, 288, 289, 297.01, 204/297.06, 212
See application file for complete search history.

(56) References Cited

U.S. PATENT DOCUMENTS

| | | | | |
|---|---|---|---|---|
| 5,102,509 | A | 4/1992 | Albon et al. | 205/257 |
| 5,783,058 | A * | 7/1998 | Fowler et al. | 205/205 |
| 6,907,666 | B2 * | 6/2005 | Mills | 29/897.2 |
| 2003/0010649 | A1 * | 1/2003 | Waite et al. | 205/640 |
| 2004/0231978 | A1 * | 11/2004 | White | 204/280 |

* cited by examiner

*Primary Examiner*—Bruce F Bell
(74) *Attorney, Agent, or Firm*—Bryn T. Lorentz; William Scott Andes

(57) ABSTRACT

Apparatus for electroplating a workpiece includes an unassembled electroplating anode assembly having weldable first and second structural anode members. The first structural anode member includes a positioning slot. The second structural anode member includes a positioning tab disposable in the positioning slot. A method for making an electroplating anode assembly includes obtaining an electroplating-anode-assembly first structural anode member having a positioning slot and obtaining an electroplating-anode-assembly second structural anode member having a positioning tab. The method also includes locating the positioning tab in the positioning slot and welding together the first and second structural anode members.

12 Claims, 2 Drawing Sheets

ELECTROPLATING APPARATUS AND METHOD FOR MAKING AN ELECTROPLATING ANODE ASSEMBLY

BACKGROUND OF THE INVENTION

The present invention relates generally to applying a coating on a workpiece, and more particularly to an electroplating apparatus and to a method for making an electroplating anode assembly.

It is known to coat turbine airfoils, such as turbine airfoils of an aircraft engine, with platinum aluminide diffusion coatings for protection against high temperature oxidation and corrosion. To develop the platinum aluminide coating, the parts are first platinum electroplated. It is known to use the electrolyte $Pt(NH_3)_4HPO_4$ for platinum electroplating turbine airfoils.

In a known electroplating method, a cathode rack supports several turbine airfoils and an anode rack supports several electroplating anode assemblies. The turbine airfoils and the electroplating anode assemblies are in contact with the $Pt(NH_3)_4HPO_4$ electrolyte, and a rectifier is employed to apply a voltage between the cathode and anode racks for platinum electroplating of the turbine airfoils. Each electroplating anode assembly has TIG (Tungsten-Inert-Gas) butt welded together first, second and third structural anode titanium (or titanium alloy) sheet-metal plate members. A conforming platinum-clad niobium anode mesh (i.e., an anode mesh having a shape which substantially conforms to the shape of a surface portion of a turbine airfoil) is supported by two of the first, second, and third structural anode plate members. The anode mesh is electrochemically active during electroplating while the sheet-metal plate members build up an anodic film and passivate during the electroplating process. Difficulties in precisely positioning the plate members for welding often result in plate positioning errors which lead to undesirable coating thickness variations, blistered platinum deposits, no platinum deposits due to short circuits, and damage to anode assemblies and turbine airfoils when the cathode and anode racks are brought into position for electroplating.

Still, scientists and engineers continue to seek improved electroplating apparatus and improved methods for making an electroplating anode assembly.

BRIEF DESCRIPTION OF THE INVENTION

A first expression of an embodiment of the invention is apparatus for electroplating a workpiece. The apparatus includes an unassembled electroplating anode assembly. The unassembled electroplating anode assembly includes weldable first and second structural anode members. The first structural anode member includes a positioning slot. The second structural anode member includes a positioning tab disposable in the positioning slot.

A first method of the invention is for making an electroplating anode assembly and includes several steps. One step includes obtaining an electroplating-anode-assembly first structural anode member having a positioning slot. Another step includes obtaining an electroplating-anode-assembly second structural anode member having a positioning tab. An additional step includes locating the positioning tab in the positioning slot. A further step includes welding together the first and second structural anode members.

In one example of the first method and the first expression of an embodiment of the invention, there is included a third structural anode member, wherein the first structural anode member has a first set of two positioning through slots and has a second set of two positioning through slots, wherein the second structural anode member has two positioning tabs matingly disposed in the two positioning slots of the first set, wherein the third structural anode member has two positioning tabs matingly disposed in the two positioning slots of the second set, wherein the slots and tabs are adapted to allow the second structural anode member to be disposed in only the positioning slots of the first set and to allow the third structural anode member to be disposed in only the positioning slots of the second set. This allows, in one implementation, shorter electroplating-anode-assembly fabrication times and precise positioning for welding together the first, second and third structural anode members.

BRIEF DESCRIPTION OF THE DRAWING

The accompanying drawing illustrates an embodiment of the invention wherein.

DETAILED DESCRIPTION OF THE INVENTION

Figure 1:
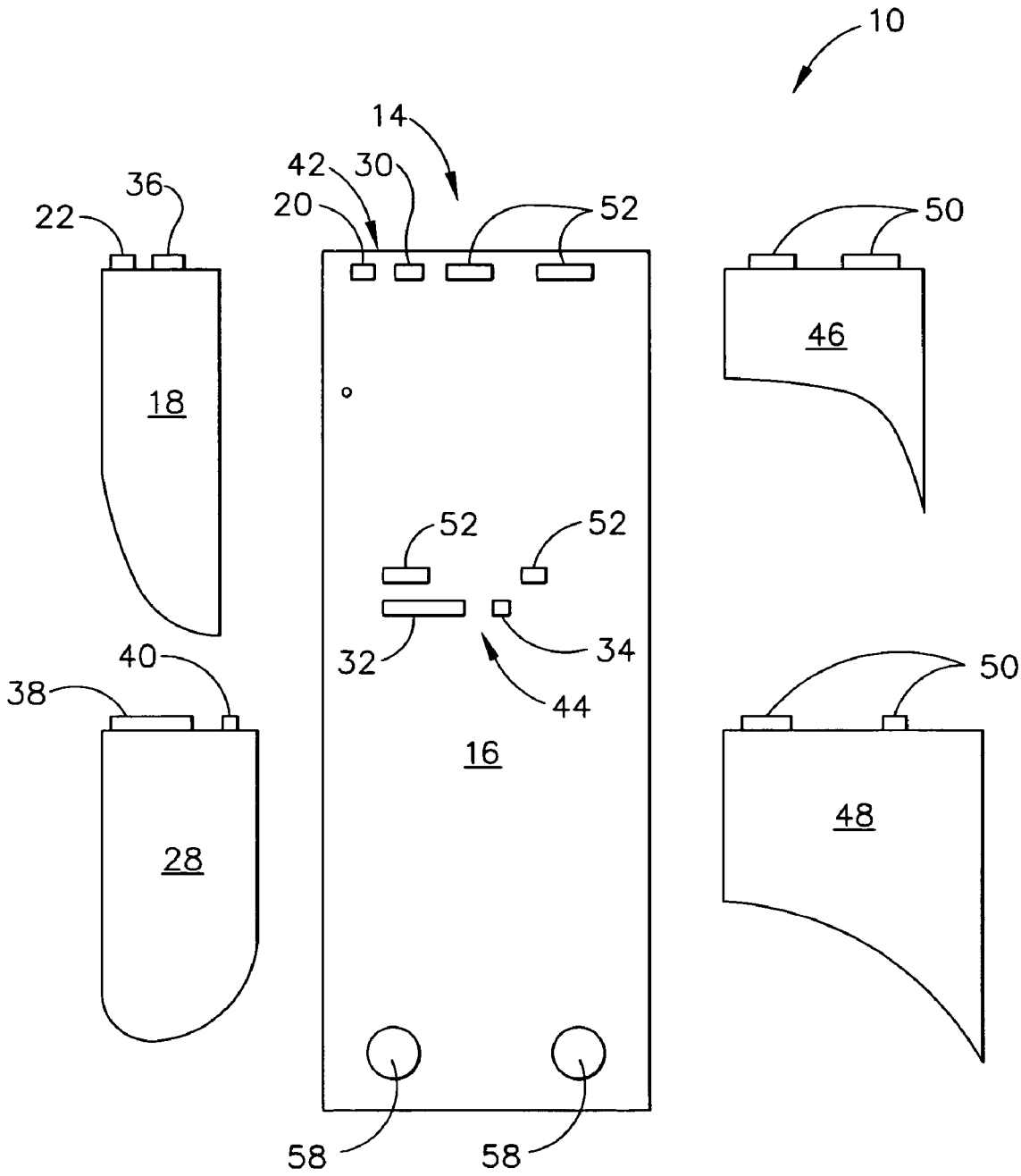
FIG. 1 is a schematic diagram of five anode structural members of an unassembled electroplating anode assembly.
Figure 2:
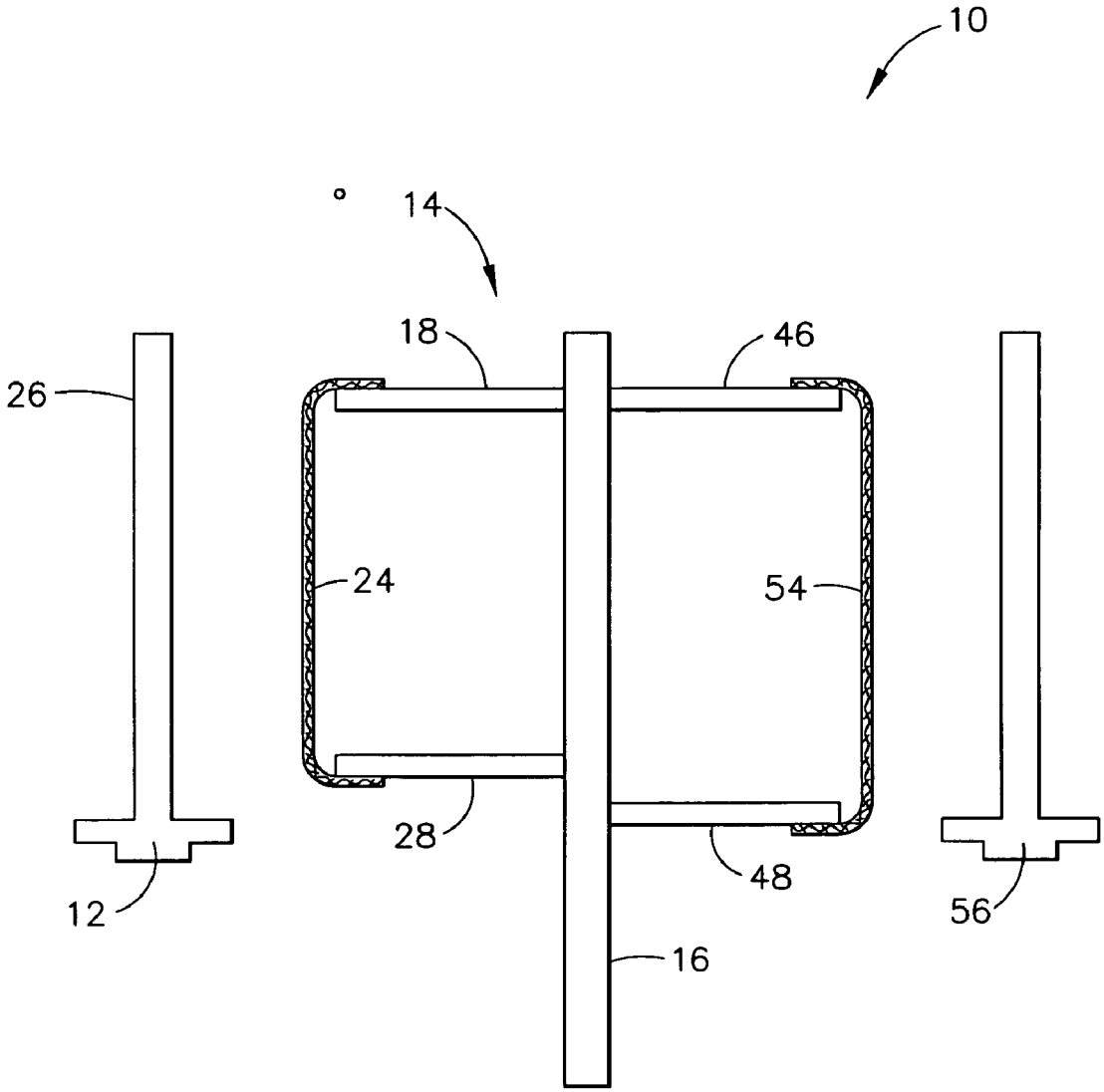
FIG. 2 is a schematic diagram of an assembled electroplating assembly having the five anode structural members of FIG. 1 and having two attached active-anode meshes each facing a surface portion of a different turbine airfoil.

Referring now to the drawing, FIGS. 1-2 disclose an embodiment of the invention. A first expression of the embodiment of FIGS. 1-2 is an apparatus 10 for electroplating a workpiece 12. The apparatus 10 includes an unassembled electroplating anode assembly 14. The electroplating anode assembly 14 includes weldable first and second structural anode members 16 and 18. By "structural" is meant substantially rigid. The first structural anode member 16 includes a positioning slot 20, and the second structural anode member 18 includes a positioning tab 22 disposable in the positioning slot 20. It is noted that describing the apparatus as having a particular component (such as an electroplating anode assembly) means that the apparatus has at least one particular component (such as at least one electroplating anode assembly). Likewise, describing a component as having a particular feature (such as a positioning slot) means that the component has at least one particular feature (such as at least one positioning slot).

A second expression of the embodiment of FIGS. 1-2 is an apparatus 10 for electroplating a workpiece 12. The apparatus 10 includes an electroplating anode assembly 14. The electroplating anode assembly 14 includes first and second structural anode members 16 and 18. The first structural anode member 16 includes a positioning slot 20. The second structural anode member 18 includes a positioning tab 22 disposed in the positioning slot 20. The first and second structural anode members 16 and 18 are welded together.

In one construction of the second expression of the embodiment of FIGS. 1-2, the positioning slot 20 is a through slot. In the same or a different construction, the first and second structural anode members 16 and 18 are substantially-rigid plate members.

In one enablement of the second expression of the embodiment of FIGS. 1-2, the electroplating anode assembly 14 also includes an active-anode mesh 24 supported by at least one of the first and second structural anode members 16 and 18. An active-anode mesh is an anode mesh which remains electrochemically active during electroplating of the workpiece. In one variation, the workpiece 12 includes a workpiece surface portion 26 having a shape, and the activate anode mesh 24 has a shape which substantially conforms to the shape of the workpiece surface portion 26. In the same or a different variation, the first and second structural anode members 16 and 18 are first and second structural inactive-anode members. A structural inactive-anode member is a structural anode member which builds up an anodic film and electrochemically passivates during electroplating of the workpiece.

A third expression of the embodiment of FIGS. 1-2 is an apparatus 10 for electroplating a workpiece 12. The apparatus 10 includes an unassembled electroplating anode assembly 14. The unassembled electroplating anode assembly 14 includes weldable first, second and third structural anode members 16, 18 and 28. The first structural anode member 16 includes positioning slots 20, 30, 32 and 34. The second and third structural anode members 18 and 28 each include two positioning tabs (tabs 22 and 36 for member 18 and tabs 38 and 40 for member 28).

The positioning slots 20, 30, 32 and 34 and positioning tabs 22, 36, 38 and 40) are adapted to allow the two positioning tabs 22 and 36 of the second structural anode member 18 to be disposed in only a particular pair of positioning slots 20 and 30 and to allow the two positioning tabs 38 and 40 of the third structural anode member 28 to be disposed in only a separate particular pair of positioning slots 32 and 34.

A fourth expression of the embodiment of FIGS. 1-2 is an apparatus 10 for electroplating a workpiece 12. The apparatus 10 includes an electroplating anode assembly 14. The electroplating anode assembly 14 includes first, second and third structural anode members 16, 18 and 28. The second and third structural anode members 18 and 28 each include two positioning tabs (tabs 22 and 36 for member 18 and tabs 38 and 40 for member 28). The first structural anode member 16 includes a first set 42 of two positioning slots 20 and 30 and a second set 44 of two positioning slots 32 and 34. The two positioning tabs 22 and 36 of the second structural anode member 18 are matingly disposed one each in the two positioning slots 20 and 30 of the first set 42. The two positioning tabs 38 and 40 of the third structural anode member 28 are matingly disposed one each in the two positioning slots 32 and 34 of the second set 44. The first, second and third structural anode members 16, 18 and 28 are welded together.

In one construction of the fourth expression of the embodiment of FIGS. 1-2, the distance between the two positioning slots 20 and 30 of the first set 42 is different from the distance between the two positioning slots 32 and 34 of the second set 44. In the same or a different construction, the length of one of the two positioning slots 20 and 30 of the first set 42 is different from the length of any of the two positioning slots 32 and 34 of the second set 44. In one variation, the length of any of the two positioning slots 20 and 30 of the first set 42 is different from the length of any of the two positioning slots 32 and 34 of the second set 44. In the same or a different construction, the length of one of the two positioning slots 20 and 30 of the first set 42 is different from the length of the other of the two positioning slots 20 and 30 of the first set 42, and the length of one of the two positioning slots 32 and 34 of the second set 44 is different from the length of the other of the two positioning slots 32 and 34 of the second set 44. In examples of one or more or all of such constructions, a structural anode member can only be assembled in a unique pair of positioning slots of another structural anode member. In one variation a structural anode member can only have one orientation in a pair of positioning slots which are non-through slots.

In one enablement of the fourth expression of the embodiment of FIGS. 1-2, the workpiece 12 is a turbine airfoil. In the same or a different enablement, the electroplating anode assembly 14 also includes an active-anode mesh 24 supported by at least two of the first, second and third structural anode members 16, 18 and 28. In one choice of materials, the first, second and third structural anode members 16, 18 and 28 comprise titanium, the active-anode mesh 24 consists essentially of platinum-clad niobium, and the turbine airfoil comprises a nickel-based superalloy. In one variation, the structural anode members are machine cut by watedjet or laser.

A first method of the invention is for making an electroplating anode assembly 14 and includes several steps. One step includes obtaining an electroplating-anode-assembly first structural anode member 16 having a positioning slot 20. Another step includes obtaining an electroplating-anode-assembly second structural anode member 18 having a positioning tab 22. An additional step includes disposing the positioning tab 22 in the positioning slot 20. A further step includes welding together the first and second structural anode members 16 and 18.

A second method of the invention is for making an electroplating anode assembly 14 for electroplating a workpiece 12 and includes steps a) through f). Step a) includes obtaining an electroplating-anode-assembly first structural anode member 16 having a first set 42 of two positioning slots 20 and 30 and a second set 44 of positioning slots 32 and 34. Step b) includes obtaining an electroplating-anode-assembly second structural anode member 18 having two positioning tabs 22 and 36 matingly disposable one each in the two positioning slots 20 and 30 of the first set 42 but not the second set 44. Step c) includes obtaining an electroplating-anode-assembly third structural anode member 28 having two positioning tabs 38 and 40 matingly disposable one each in the two positioning slots 32 and 34 of the second set 44 but not the first set 42. Step d) includes matingly disposing the two positioning tabs 22 and 36 of the second structural anode member 18 in the two positioning slots 20 and 30 of the first set 42. Step e) includes matingly disposing the two positioning tabs 38 and 40 of the third structural anode member 28 in the two positioning slots 32 and 34 of the second set 44. Step f) includes welding together the first, second and third structural anode members 16, 18 and 28.

In one implementation of the second method, during step d), a particular one of the two positioning tabs 22 and 36 of the second structural anode member 18 is disposable in only a particular one of the two positioning slots 20 and 30 of the first set 42, and, during step e), a particular one of the two positioning tabs 38 and 40 of the third structural anode member 28 is disposable in only a particular one of the two positioning slots 32 and 34 of the second set 44.

In one enablement of the second method, the positioning slots 20, 30, 32 and 34 of the first and second sets 42 and 44 are through slots. In one variation, the positioning tabs 22, 36, 38 and 40 of the second and third structural anode members 18 and 28 have free ends, and step f) includes welding the free ends of the matingly-disposed positioning tabs 22, 36, 38 and 40 of the second and third structural anode members 18 and 28 to the first structural anode member 16.

In one application of the second method, the workpiece 12 is a turbine airfoil. In one variation, the second method also includes the step of obtaining an active-anode mesh 24 having a shape substantially conforming to the shape of a surface portion of the turbine airfoil and the step of securing the active-anode mesh 24 to the second and third structural anode members 18 and 28. In one modification, the active-anode mesh 24 is spot welded to the second and third structural anode members 18 and 28.

It is noted that the previously-described constructions, enablements, variations, etc. of any of the methods and expressions of the embodiment of FIGS. 1-2 are equally applicable to any one or more or all of the other of the methods and expressions of the embodiment of FIGS. 1-2. In one extension of any one or more or all of the previously-described methods and expressions of an embodiment of the invention, the electroplating anode assembly 14 includes two additional structural anode members 46 and 48 having positioning tabs 50. In this extension, the first structural anode member 16 has additional positioning slots 52, the positioning tabs 50 of the two additional structural anode members 46 and 48 are disposable/disposed in the additional positioning slots 52, the two additional structural anode members 46 and 48 are weldable/welded to the first structural anode member 16, and an additional active-anode mesh 54 is securable/secured to the two additional structural anode members 46 and 48 for electroplating a surface portion of an additional workpiece 56. In one utilization, the electroplating anode assembly 14 is copied a plurality of times with all of the electroplating anode assemblies supported by an anode rack (not shown) such as a titanium (or titanium alloy) anode rack. In one example, the first structural anode member 16 has attachment holes 58 for bolt-attachment to the anode rack. A cathode rack (not shown), such as a stainless steel cathode rack, supports a multiplicity of workpieces such as turbine airfoils. An electrolyte, such as $Pt(NH_3)_4HPO_4$ is in contact with the workpieces and the active anode meshes (such as 125DCX screen available from Vincent Metals Corporation of Rhode Island), and a rectifier applies a dc (direct current) voltage across the cathode and anode racks to electroplate the workpieces. In one experiment, electroplating anode assemblies for electroplating 16 turbine airfoils were fabricated within 12 hours using the principles of the invention compared to a fabrication time of up to 40 hours using conventional electroplating-anode-assembly techniques.

While the present invention has been illustrated by a description of several methods and expressions of an embodiment, it is not the intention of the applicants to restrict or limit the spirit and scope of the appended claims to such detail. Numerous other variations, changes, and substitutions will occur to those skilled in the art without departing from the scope of the invention.

The invention claimed is:

1. An electroplating anode assembly for electroplating a workpiece comprising an unassembled electroplating anode assembly including weldable first, second and third structural anode members, wherein the first structural anode member includes positioning slots and wherein the second and third structural anode members each include two positioning tabs, and wherein the positioning slots and positioning tabs are adapted to allow the two positioning tabs of the second structural anode member to be disposed in only a particular pair of positioning slots and to allow the two positioning tabs of the third structural anode member to be disposed in only a separate particular pair of positioning slots wherein the electroplating anode assembly includes an active anode mesh supported by at least two of the first, second and third structural members.

2. An electroplating anode assembly for electroplating a workpiece comprising an electroplating anode assembly including first, second and third structural anode members, wherein the second and third structural anode members each include two positioning tabs, wherein the first structural anode member includes a first set of two positioning slots and a second set of two positioning slots, wherein the two positioning tabs of the second structural anode member are matingly disposed one each in the two positioning slots of the first set, wherein the two positioning tabs of the third structural anode member are matingly disposed one each in the two positioning slots of the second set, and wherein the first, second and third structural anode members are welded together wherein the electroplating anode assembly includes an active anode mesh supported by at least two of the first, second and third structural members.

3. The assembly of claim 2, wherein the distance between the two positioning slots of the first set is different from the distance between the two positioning slots of the second set.

4. The apparatus of claim 2, wherein the length of one of the two positioning slots of the first set is different from the length of any of the two positioning slots of the second set.

5. The apparatus of claim 4, wherein the length of any of the two positioning slots of the first set is different from the length of any of the two positioning slots of the second set.

6. The apparatus of claim 2, wherein the length of one of the two positioning slots of the first set is different from the length of the other of the two positioning slots of the first set, and wherein the length of one of the two positioning slots of the second set is different from the length of the other of the two positioning slots of the second set.

7. The apparatus of claim 2, wherein the workpiece is a turbine airfoil.

8. The apparatus of claim 7, wherein the first, second and third structural anode members comprise titanium and wherein the active-anode mesh consists essentially of platinum-clad niobium.

9. A method for making an electroplating anode assembly for electroplating a workpiece comprising the steps of:

a) obtaining an electroplating-anode-assembly first structural anode member having a first set of two positioning slots and a second set of positioning slots;

b) obtaining an electroplating-anode-assembly second structural anode member having two positioning tabs matingly disposable one each in the two positioning slots of the first set but not the second set;

c) obtaining an electroplating-anode-assembly third structural anode member having two positioning tabs matingly disposable one each in the two positioning slots of the second set but not the first set;

d) matingly disposing the two positioning tabs of the second structural anode member in the two positioning slots of the first set;

e) matingly disposing the two positioning tabs of the third structural anode member in the two positioning slots of the second set; and f) welding together the first, second and third structural anode members.

10. The method of claim 9, wherein, during step d), a particular one of the two positioning tabs of the second structural anode member is disposable in only a particular one of the two positioning slots of the first set, and wherein, during step e), a particular one of the two positioning tabs of the third structural anode member is disposable in only a particular one of the two positioning slots of the second set.

11. The method of claim 9, wherein the positioning slots of the first and second sets are through slots, wherein the positioning tabs of the second and third structural anode members have free ends, and wherein step f) includes welding the free ends of the matingly-disposed positioning tabs of the second and third structural anode members to the first structural anode member.

12. The method of claim 11, wherein the workpiece is a turbine airfoil, and also including the step of obtaining an active-anode mesh having a shape substantially conforming to the shape of a surface portion of the turbine airfoil and the step of securing the active-anode mesh to the second and third structural anode members.

* * * * *